US006351082B1

(12) United States Patent
Fah

(10) Patent No.: US 6,351,082 B1
(45) Date of Patent: Feb. 26, 2002

(54) ELECTRONIC BALLAST FOR A FLUORESCENT LAMP

(75) Inventor: Foo Onn Fah, Hong Kong (HK)

(73) Assignee: Mass Technology (H.K.) Ltd., Kowloon (HK)

( * ) Notice: Subject to any disclaimer, the term of this patent is extended or adjusted under 35 U.S.C. 154(b) by 0 days.

(21) Appl. No.: 09/725,237

(22) Filed: Nov. 29, 2000

(30) Foreign Application Priority Data

Nov. 30, 1999 (EP) ..... 99123725

(51) Int. Cl.[7] ..... G05F 1/00

(52) U.S. Cl. ..... 315/291; 315/209 R; 315/219; 315/307; 315/200 R

(58) Field of Search ..... 315/291, 209 R, 315/219, 224, 225, 307, DIG. 5, 246, 276, 279, 200 R

(56) References Cited

U.S. PATENT DOCUMENTS 4,954,754 A 9/1990 Nilssen ..... 315/219
4,959,591 A * 9/1990 Hirschmann ..... 315/209 R
5,402,043 A 3/1995 Nilssen ..... 315/307
5,512,801 A 4/1996 Nilssen ..... 315/209 R
5,677,601 A * 10/1997 Zuchtriegel ..... 315/209 R
5,898,278 A * 4/1999 Muessli ..... 315/209 R
5,925,984 A * 7/1999 Fisher et al. ..... 315/219

FOREIGN PATENT DOCUMENTS

EP 00 99 474 2/1984

* cited by examiner

*Primary Examiner*—Don Wong
*Assistant Examiner*—Tuyet T. Vo
(74) *Attorney, Agent, or Firm*—Smith, Gambrell & Russelll, LLP

(57) ABSTRACT

An electronic ballast for a fluorescent lamp with low voltage power supply is composed of a wave filter circuit, a rectifier circuit, a generation and control circuit of high frequency and an ignition circuit of the lamp tube. The output end of the wave filter circuit is connected to the input end of the rectifier circuit. The output end of the rectifier circuit is connected to the generation and control circuit of high frequency and the ignition circuit of the lamp tube. The feedback transformer is put into the output circuit of the generation and control circuit of high frequency.

5 Claims, 3 Drawing Sheets

ELECTRONIC BALLAST FOR A FLUORESCENT LAMP

BACKGROUND OF THE INVENTION

The present invention relates to an electronic ballast for a fluorescent lamp with low-voltage power supply comprising a wave filter connected with its output to the input of a rectifier circuit which is connected with its output to the input of a generation and control circuit of high frequency the output end of which is connected to a resonance circuit composed of a choke and a capacitor and an ignition circuit; the generation and control circuit including two solid state switches and a feedback transformer means which is put with its primary circuit into the output of the generation and control circuit. Mainly the present invention relates to a circuit for the ignition and control of a fluorescent lamp.

The electronic ballast of fluorescent lamps is composed of a rectifier circuit, a wave filter circuit, a generation and control circuit of high frequency, an ignition circuit of the lamp tube, etc. In a fluorescent lamp with discharge in low-voltage mercury vapor using the electronic ballast, the direct current voltage that is supplied to the converting transistor of the generation and control circuit will be too low when the voltage of the power supply is 120 V or lower and the circuit of the electronic ballast works under cheap and reliable direct rectification. Thus the voltage after conversion will be also too low. Because of this, the fluorescent lamp cannot work stably and normally. In order to solve the problem of the insuffucient low-voltage of high frequency, one of the methods is to add a resonance circuit to the output end of high frequency so that the voltage of high frequency that is supplied to the lamp tube can be raised.

In FIG. 1 of the drawing there is shown the principle diagram of a circuit of the electronic ballast for a fluorescent lamp. A wave filter comprising capacitor C1 and choke L0 is connected to the low-voltage mains. The output of the wave filter circuit is connected to the input of a rectifier circuit composed of diodes D1–D4. The output of the rectifier circuit is connected to the input of a generation and control circuit of high frequency comprising two transistors V1, V2, resistors R2, R3, R4, R5, capacitors C4, C5, diode D5, and feedback transformer B1. Connected to the output of the rectifier circuit is a filtering capacitor C2. Resistor R1 and capacitor C3 are connected in series to the output of the rectifier circuit. The collector of transistor V1 is connected to the positive output of the rectifier circuit. The emitter of transistor V2 is connected to the negative output of the rectifier circuit. The emitter of transistor V1 is connected to the collector of transistor V2. Connected to the joint point of emitter of transistor V1 and collector of transistor V2 is the primary coil B1-1 of feedback transformer B1. Secondary coil B1-2 of feedback transformer B1 is connected in series with resistor R3 which is connected to the base of transistor V1. Resistor R4 is connected to the base of transistor V2 and the secondary coil B1-3 of feedback transformer B1. One end of the secondary coil B1-3 is connected to the negative output of the rectifier circuit. One end of secondary coil B1-2 is connected to the joint point of emitter of transistor V1 and collector of transistor V2. The second end of capacitor C5 is connected to one tap or contact respectively of the lamp F. The other plug-in pin or contact of the lamp F is connected to one end of a choke L and one end of a capacitor C7 which is connected with its other end to the negative output of the rectifier circuit. One end of the choke L is connected to the primary coil B1-1 of feedback transformer B1. The starting circuit of the fluorescent lamp F includes a capacitor C3 in series with resistor R1 and DIAC DB 3.

In the electronic ballast circuit shown in FIG. 1 capacitor C7 and choke L form a resonant circuit. Because the capacity of C2 and C5 is relatively big, the voltage of high frequency on C7 is mainly supplied to the two ends of the lamp tube so that the lamp tube can work normally. There are great defects in this circuit if the lamp tube is a part that can be changed. Firstly, the resonance circuit C7 and L will work under the idle situation and the transistor will be burnt out quickly if the plug-in pins of the lamp tube have a loose contact and the lamp tube itself does not work normally. Secondly, the safety regulation requirements of the changeable lamp tube cannot be fulfilled.

SUMMARY OF THE INVENTION

It is an object of the present invention to overcome the above mentioned defects and to provide an electronic ballast which will not fail if the lamp tube has a loose contact or the lamp tube is removed from its lampholder.

An electronic ballast for a fluorescent lamp with low-voltage power supply according to the invention comprises a wave filter connected with its output to the input of a rectifier circuit, which is connected with its output to the input of a generation and control circuit of high frequency, the output end of which is connected to the resonance circuit composed of a choke and a capacitor, and an ignition circuit, the generation and control circuit including two solid state switches and feedback transformer means which is put with its primary circuits into the output of the generation and control circuit; at least one coil of the primary circuit of the feedback transformer means for supplying feedback to one of the solid state switches is connected between the joint of the choke and the capacitor of the resonance circuit and one contact of the fluorescent lamp. The normal work of the generation and control circuit of high frequency is maintained by the positive feedback that is formed through each group of coils in the feedback transformer. Thus the primary feedback coil will have no feedback current in the feedback transformer if the lamp tube has a loose contact or an open circuit. Thereby the solid state switch, for instance a transistor, stops working and the safety regulation requirements of the changeable lamp tube are fulfilled. Preferably the feedback transformer means comprises two transformers and the primary feedback coil is connected on the two transformers between the joint of the choke and the capacitor of said resonance circuit and said one contact of the fluorescent lamp.

In another preferred embodiment of the present invention the feedback transformer means comprises one primary feedback coil connected with a two holes transformer. In still another preferred embodiment of the present invention the primary feedback means comprises two transformers; one transformer being connected in the front and one at the back of the choke.

In another preferred embodiment of the present invention the primary feedback transformer means comprises one transformer including two primary feedback coils one coil being connected in the front and one coil being connected to the back of the choke. The invention will be further explained hereinafter by reference to the drawings.

DETAILED DESCRIPTION OF THE PREFERRED EMBODIMENTS

Preferred embodiments of the present invention will be described with reference to the accompanying drawings.

Figure 1:
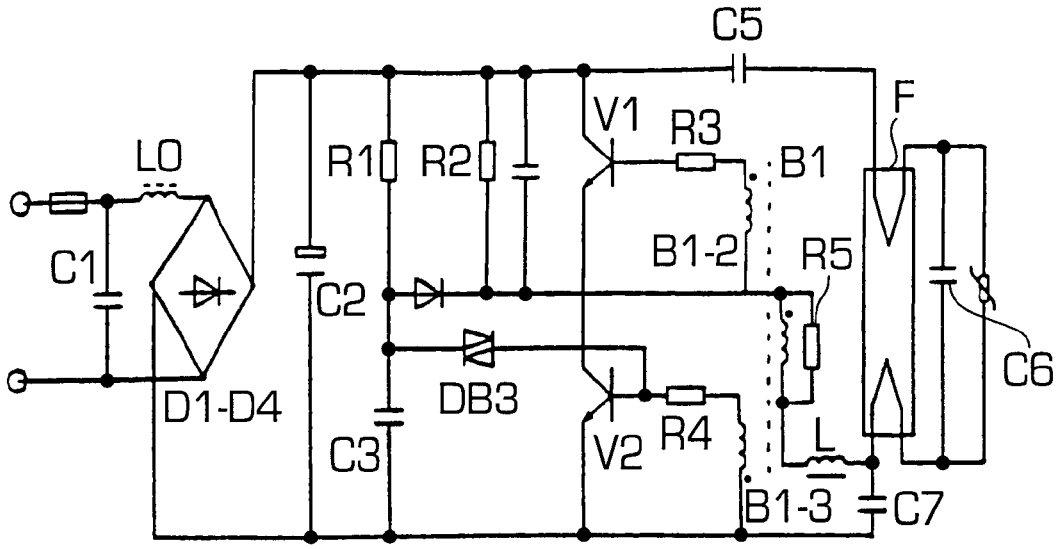
FIG. 1 PRIOR ART
FIG. 1 is a circuit diagram showing a conventional electronic ballast.
Figure 2:
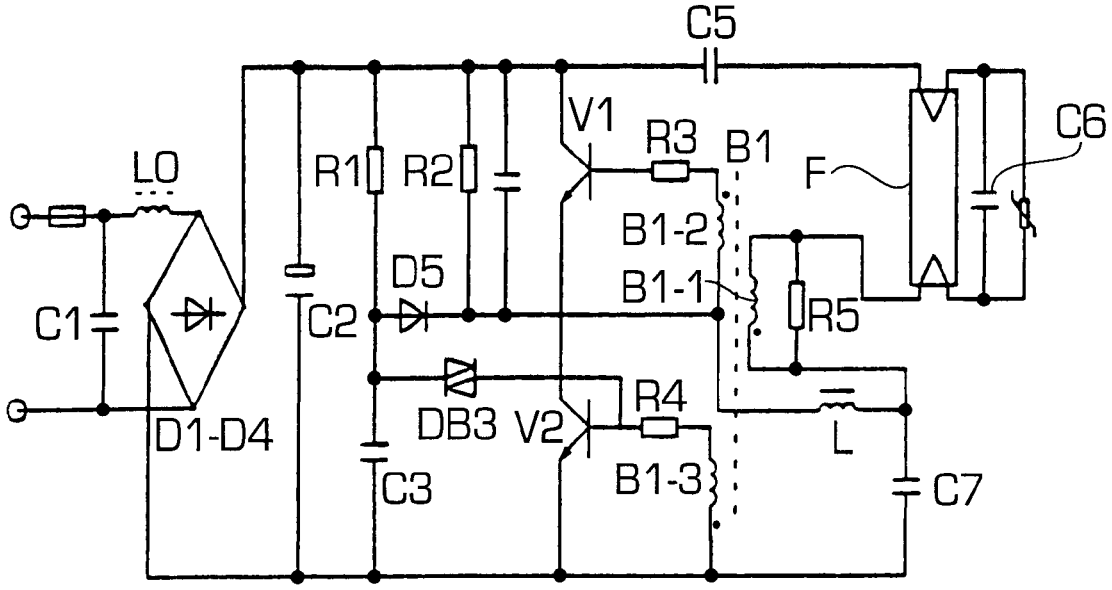
FIG. 2 is a principle circuit diagram showing an electronic ballast according to the invention.

Referring to FIG. 2 of the drawing which shows a diagram of an electronic ballast of the present invention, the ballast comprises a wave filter circuit composed of choke L0 and capacitor C1, a bridge rectifier circuit composed of bridge stacks D1–D4, a generation and control circuit of high frequency, an ignition circuit for the lamp tube and a resonance circuit. The generation and control circuit comprises transistors V1, V2 and their supplementary components for instance resistors R2, R3 and R4, and feedback transformer B1. The ignition circuit of the lamp tube is composed for instance of DIAC DB 3, capacitor C3 and resistor R1. In the FIGS. 2 to 6 references L0, C1, C2, C3, C4, C5, C6, C7, R1, R2, R3, R4, R5, D1–D4, D5, DB3, V1, V2, F, and L identify like elements of the circuit in FIG. 1.

According to FIG. 2 the feedback transformer B1 has a primary feedback coil B1-1 which is connected in parallel with the resistor R5, the choke L of the resonance circuit is put in the output of the generation and control circuit by connecting over end to the joint of the emitter of transistor V1 and collector of transistor V2. The other end of choke L is connected to one end of capacitor C7 and one end to the primary feedback coil B1-1. The other end of the feedback coil B1-1 is connected to one contactor cap of the fluorescent lamp tube F. Thus the primary feedback coil B1-1 of the feedback transformer B1 is connected to the back of the choke inductance.

Figure 3:
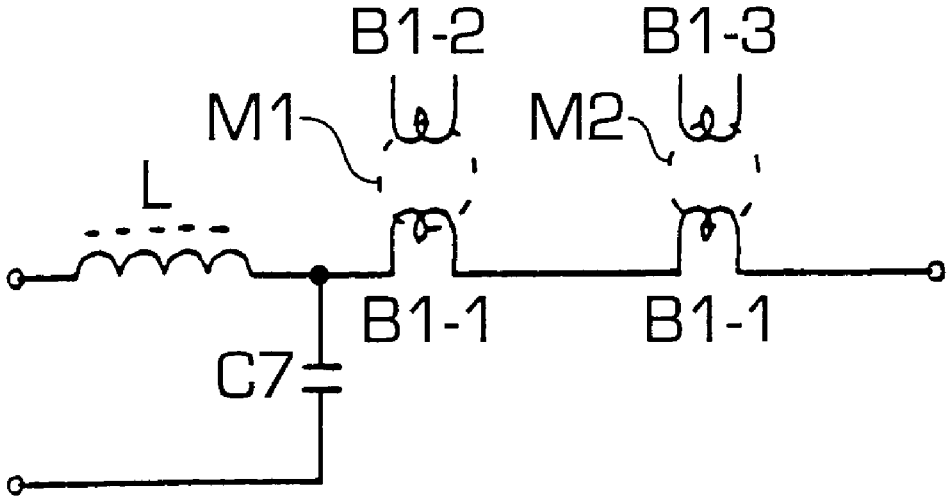
FIG. 3 is a principle circuit diagram showing feedback means with two feedback transformers according to the invention.
Figure 4:
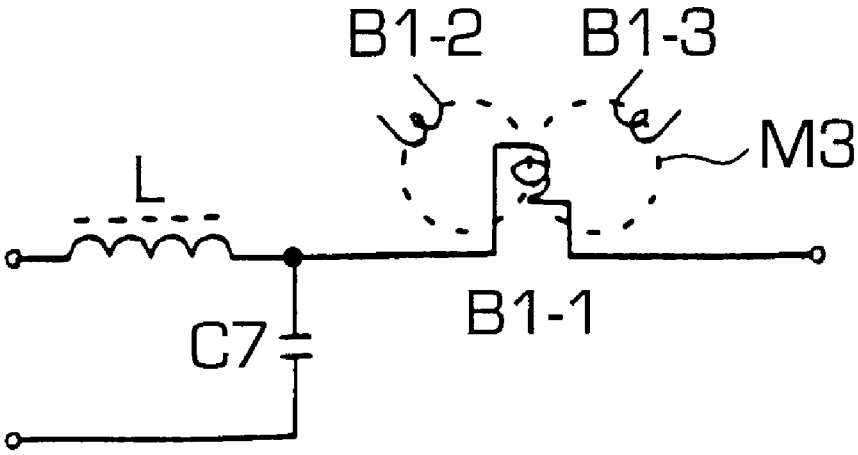
FIG. 4 is a principle circuit diagram showing a feedback transformer with two holes and one primary feedback coil according to the invention.

The feedback transformer B1 may comprise two magnet cores M1, M2 as shown in FIG. 3. The primary feedback circuit of transformer B1 is divided in two coils B1-1. Each core M1, M2 is provided with one half of the primary feedback coil B1-1. Each core M1, M2 is provided with a secondary coil B1-2 or B1-3 of the feedback transformer B1. The feedback transformer B1 may comprise two a two holes transformer M3. The primary feedback coil B1-1 according to FIG. 3 and 4 is connected to the choke L and the lamp tube as shown in FIG. 2.

Figure 5:
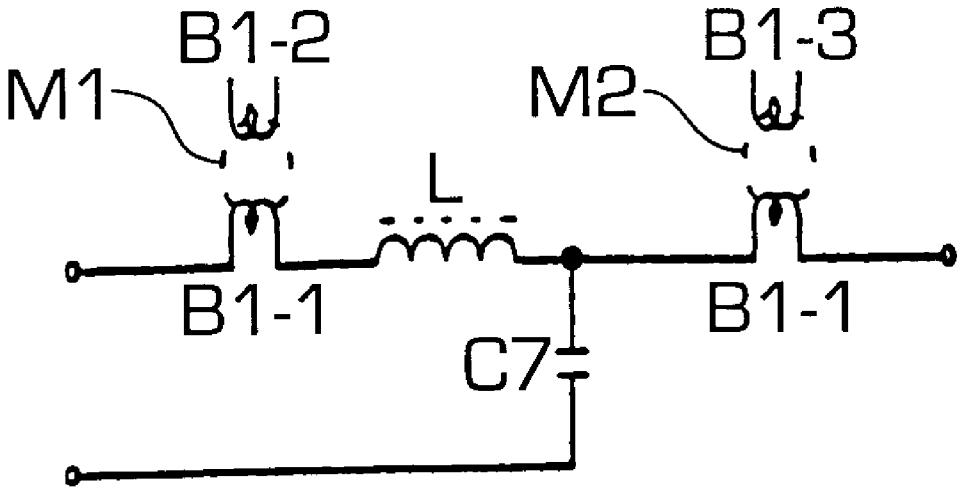
FIG. 5 is a principle circuit diagram showing two feedback transformers having a primary feedback coil each with one transformer in the front and one transformer in the back of the choke of a resonance circuit according to the invention.
Figure 6:
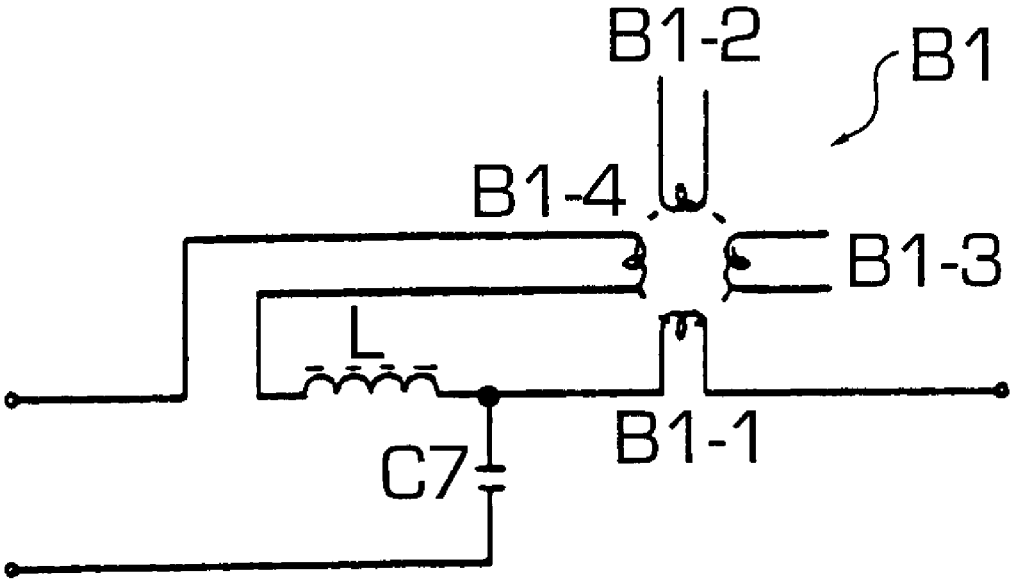
FIG. 6 is a principle circuit diagram showing a feedback transformer having two primary feedback coils one of the coils being connected in the front and the other one at the back of the choke of a resonance circuit according to the invention.

FIG. 5 shows another embodiment of the present invention. The primary feedback circuit of transformer B1 has two magnetic cores M1, M2 with primary feedback coils B1-1, B1-1. One coil B1-1 which is on core M1 is connected in the front and one coil B1-1 which is on core M2 is connected at the back choke L. The coil B1 in the front of the choke is connected with one end to the joint collector of transistor V2 and the emitter of transistor V1. The coil B1-1 at the back of choke L is connected with one end to the lamp tube F. in the embodiment of the present invention shown in FIG. 6 the feedback transformer B1 is provided with one core M4. The primary feedback circuit is divided up in coils B1-1 and B1-4. Coil B1-4 is connected in the front of choke L and coil B1-1 at the back of choke L. If the lamp tube has a loose contact or if there is no lamp in the lampholder, at least one solid state switch will receive no feedback. This switch will be non-conductive. Therefore the electronic ballast stops working.

What is claimed is:

1. An electronic ballast for a fluorescent lamp with low-voltage power supply comprising a wave filter connected with its output to the input of a rectifier circuit which is connected with its output to the input of a generation and control circuit of high frequency to the output end of which is connected to a resonance circuit composed of a choke (L) and a capacitor (C7), and an ignition circuit; the generation and control circuit including two solid state switches and feedback transformer means (B1) which is put with its primary circuit into the output of the generation and control circuit; at least one coil (B1-1) of the primary circuit of the feedback transformer means for supplying feedback to one of the solid state switches is connected between the joint of the choke (L) and the capacitor (C7) of the resonance circuit and one contact of the fluorescent lamp (F).

2. Electronic ballast according to claim 1, characterized in that the feedback transformer means comprises two transformers and said primary feedback coil (B1-1) is connected on said two transformers between the joint of said choke (L) and said capacitor (C7) of the resonance circuit and one contact of the fluorescent lamp (F).

3. Electronic ballast according to claim 1, characterized in that the feedback transformer means comprises one primary feedback coil (B1-1) connected with a two holes transformer.

4. Electronic ballast according to claim 1, characterized in that the primary feedback transformer means comprises two transformers connected with one transformer in the front and one transformer at the back of said choke (L).

5. Electronic ballast according to claim 1, characterized in that the primary feedback means comprises one transformer including two primary feedback coils (B1-1, B1-4) one coil (B1-4) being connected in the front and one coil being connected to the back of said choke (L).

* * * * *